US010788783B2

(12) United States Patent
Miyoshi

(10) Patent No.: US 10,788,783 B2
(45) **Date of Patent: *Sep. 29, 2020**

(54) IMAGE FORMING APPARATUS AND METHOD FOR DEMANDING MORE FLEXIBLE PRINTING PROCESSING

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Nobuyuki Miyoshi, Shimizu Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/662,098

(22) Filed: Oct. 24, 2019

(65) Prior Publication Data

US 2020/0057409 A1 Feb. 20, 2020

Related U.S. Application Data

(63) Continuation of application No. 15/982,002, filed on May 17, 2018, now abandoned, which is a (Continued)

(30) Foreign Application Priority Data

Jul. 31, 2015 (JP) ..... 2015-151490

(51) Int. Cl.

| | |
|---|---|
| ***G03G 15/01*** | (2006.01) |
| ***G03G 21/00*** | (2006.01) |
| ***B41M 7/00*** | (2006.01) |
| ***G03G 15/20*** | (2006.01) |

(52) U.S. Cl.

CPC ..... *G03G 21/00* (2013.01); *B41M 7/0009* (2013.01); *G03G 15/01* (2013.01); *G03G 15/2039* (2013.01); *G03G 2215/0132* (2013.01)

(58) Field of Classification Search

CPC .... G03G 15/01; G03G 15/2039; G03G 21/00; B41M 7/0009

See application file for complete search history.

(56) References Cited

U.S. PATENT DOCUMENTS 6,408,144 B2 * 6/2002 Sasai ..... H04N 1/00015 399/44
9,007,607 B2 * 4/2015 Suzuki ..... H04N 1/00352 358/1.13

(Continued)

FOREIGN PATENT DOCUMENTS

JP 10-171198 6/1998

OTHER PUBLICATIONS

Non-Final Office Action for U.S. Appl. No. 15/210,000 dated Jun. 23, 2017.

(Continued)

*Primary Examiner* — Lamson D Nguyen
(74) *Attorney, Agent, or Firm* — Amin, Turocy & Watson, LLP

(57) ABSTRACT

A method for demanding a more flexible printing processing by an image forming apparatus which comprises a first storage section and a second storage section involves deciding whether to print the image information contained in the file; determining whether or not an image indicated by the emphasis information stored in the second storage section is contained in the image information contained in the file if the decision is carried out; creating a print command to print the image indicated by the emphasis information with a decolorable recording material in a case in which it is (Continued)

determined that the image indicated by the emphasis information is contained in the image information contained in the file; and sending the created print command through the communication section.

15 Claims, 19 Drawing Sheets

Related U.S. Application Data continuation of application No. 15/210,000, filed on Jul. 14, 2016, now Pat. No. 9,996,045.

(56) References Cited

U.S. PATENT DOCUMENTS 9,205,668 B2 12/2015 Morizumi
9,348,546 B2 5/2016 Hibino et al.
9,844,964 B2 12/2017 Yokoyama
9,860,420 B2 1/2018 Sugiyama
9,996,045 B2 * 6/2018 Miyoshi ..... B41M 7/0009

OTHER PUBLICATIONS

Non-Final Office Action for U.S. Appl. No. 15/464,647 dated Jul. 3, 2017.
Non-Final Office Action for U.S. Appl. No. 15/464,647 dated Dec. 19, 2017.
Japanese Office Action for Japanese Patent Application No. 2015-151490 dated Feb. 12, 2019.
Non-Final Office Action for U.S. Appl. No. 15/982,002 dated Mar. 22, 2019.
Final Office Action for U.S. Appl. No. 15/464,647 dated Sep. 10, 2018.

* cited by examiner

FIG.5

CYAN TONER

| | | | | | |
|---|---|---|---|---|---|
| 1 | 0 | *** | | | |
| 0 | 0 | *** | | | |
| ⋮ | ⋮ | ⋱ | | | |
| | | | | | |
| | | | | | |
| | | | | | |

MAGENTA TONER

| | | | | | |
|---|---|---|---|---|---|
| 0 | 0 | *** | | | |
| 1 | 0 | *** | | | |
| ⋮ | ⋮ | ⋱ | | | |
| | | | | | |
| | | | | | |
| | | | | | |

YELLOW TONER

| | | | | | |
|---|---|---|---|---|---|
| 0 | 1 | *** | | | |
| 0 | 0 | *** | | | |
| ⋮ | ⋮ | ⋱ | | | |
| | | | | | |
| | | | | | |
| | | | | | |

BLACK TONER

| | | | | | |
|---|---|---|---|---|---|
| 0 | 0 | *** | | | |
| 0 | 1 | *** | | | |
| ⋮ | ⋮ | ⋱ | | | |
| | | | | | |
| | | | | | |
| | | | | | |

FIG.7

55a

| EMPHASIS INFORMATION | IDENTIFIER |
|---|---|
| UNDERLINE | 0001 |
| BOLD TYPE | 0002 |
| RED CHARACTER | 0003 |
| NUMBER | 0004 |

FIG.8

55b

| EMPHASIS INFORMATION | IDENTIFIER |
| --- | --- |
| UNDERLINE | 0001 |
| BOLD TYPE | 0002 |

FIG.10

DOCUMENT C

AAAAAAAAAAAAAAAAAAAA
AAAAAAAAAAAAAAAAAAAA
AAAAAAAAAAAAAAAAAAAA
AAAAAAAAAABBBBBBBBBB
AAAAAAAAAAAAAAAAAAAA
AAAAAAAACCCCCCCAAAAA
AAAAAAAAAAAAAAAAAAAA

AAAAAAAAAAAAAAAAAAAA
AAAAAAAAAAAAAAAAAAAA
AAAAAAAAAAAAAAAAAAAA
AAAAAAAAAABBBBBBBBBB
AAAAAAAAAAAAAAAAAAAA
AAAAAAAACCCCCCCAAAAA
AAAAAAAAAAAAAAAAAAAA

FIG.16

353a

| EMPHASIS INFORMATION | IDENTIFIER |
|---|---|
| UNDERLINE | 0001 |
| BOLD TYPE | 0002 |
| RED CHARACTER | 0003 |
| NUMBER | 0004 |

FIG.17

353b

| EMPHASIS INFORMATION | IDENTIFIER |
| --- | --- |
| UNDERLINE | 0001 |
| BOLD TYPE | 0002 |

IMAGE FORMING APPARATUS AND METHOD FOR DEMANDING MORE FLEXIBLE PRINTING PROCESSING

CROSS-REFERENCE TO RELATED APPLICATIONS

This application is a Continuation of application Ser. No. 15/982,002 filed May 17, 2018, which is a Continuation of application Ser. No. 15/210,000 filed Jul. 14, 2016, the entire contents of both of which are incorporated herein by reference.

This application is based upon and claims the benefit of priority from Japanese Patent Application No. 2015-151490, filed Jul. 31, 2015, the entire contents of which are incorporated herein by reference.

FIELD

Embodiments described herein relate generally to an image forming apparatus and a method for demanding a more flexible printing processing.

BACKGROUND

As one type of an image forming apparatus, there is known an image forming apparatus equipped with a so-called image erasing apparatus that prints an image on a sheet with the use of a recording material, for example a decolorable toner, and furthermore carries out a decoloring processing on the toner used for forming the image through heating to erase the image printed on the sheet. In the image erasing apparatus, a reading section that reads the image in order to store the image before the image is erased and a decoloring section that decolors the toner for forming the image are comprised, and it is known to read the image again with the foregoing reading section to determine whether or not the decoloring processing of the toner is normally performed after the image is erased. In this way, at the time the image formed on the sheet is erased, a series of operations including reading and storing contents of the sheet with the reading section and decoloring the image are carried out. However, the contents printed on the sheet are various. Thus, there is a case in which in one sheet, a location at which a user wants to print the sheet with decolorable toner and a location at which the user wants to print the sheet with normal toner are mixed, and thus a more flexible printing processing is demanded.

DESCRIPTION OF THE DRAWINGS

FIG. 5 is a diagram schematically illustrating a bitmap image according to the first embodiment;

FIG. 7 is a diagram schematically illustrating an emphasis information candidate file stored in an HDD of an MFP according to the first embodiment;

FIG. 8 is a diagram schematically illustrating an emphasis information storage file stored in the HDD of the MFP according to the first embodiment;

FIG. 10 is a diagram illustrating a copied document C according to the first embodiment and the second embodiment;

FIG. 16 is a diagram schematically illustrating an emphasis information candidate file stored in an HDD of the PC according to the second embodiment;

FIG. 17 is a diagram schematically illustrating an emphasis information storage area stored in the HDD of the PC according to the second embodiment;

DETAILED DESCRIPTION

In accordance with an embodiment, an image forming apparatus comprises a first storage section configured to store image information to be printed, a printing section configured to include a decolorable recording material and non-decolorable recording material and print an image based on the image information stored in the first storage section with the decolorable recording material in a case in which the image meets a predetermined condition, a second storage section configured to store emphasis information for emphasizing a specific image, and a control section configured to control the printing section to print an image indicated by the emphasis information stored in the second storage section with the decolorable recording material in a case in which the image meets the predetermined condition existing in the image information stored in the first storage section.

Hereinafter, embodiments of the present invention are described with reference to the accompanying drawings. In the present embodiment, an MFP (Multi-Function Peripheral) 100 is described as an example of the image forming apparatus.

In a first embodiment and a second embodiment, in a copied document C, as shown in FIG. 10, "A" meaning that a character is not emphasized, "B" meaning that a character is emphasized in bold type and "C" meaning that a character is emphasized with an underline are recorded. In the first embodiment, the document C refers to a sheet on which the image is formed. Further, in the second embodiment, the document C refers to a document file. As an example of a recording material, decolorable toner and non-decolorable toner are described as examples; however, the recording material is not limited to them. The recording material may be decolorable ink and non-decolorable ink.

First Embodiment

Figure 1:
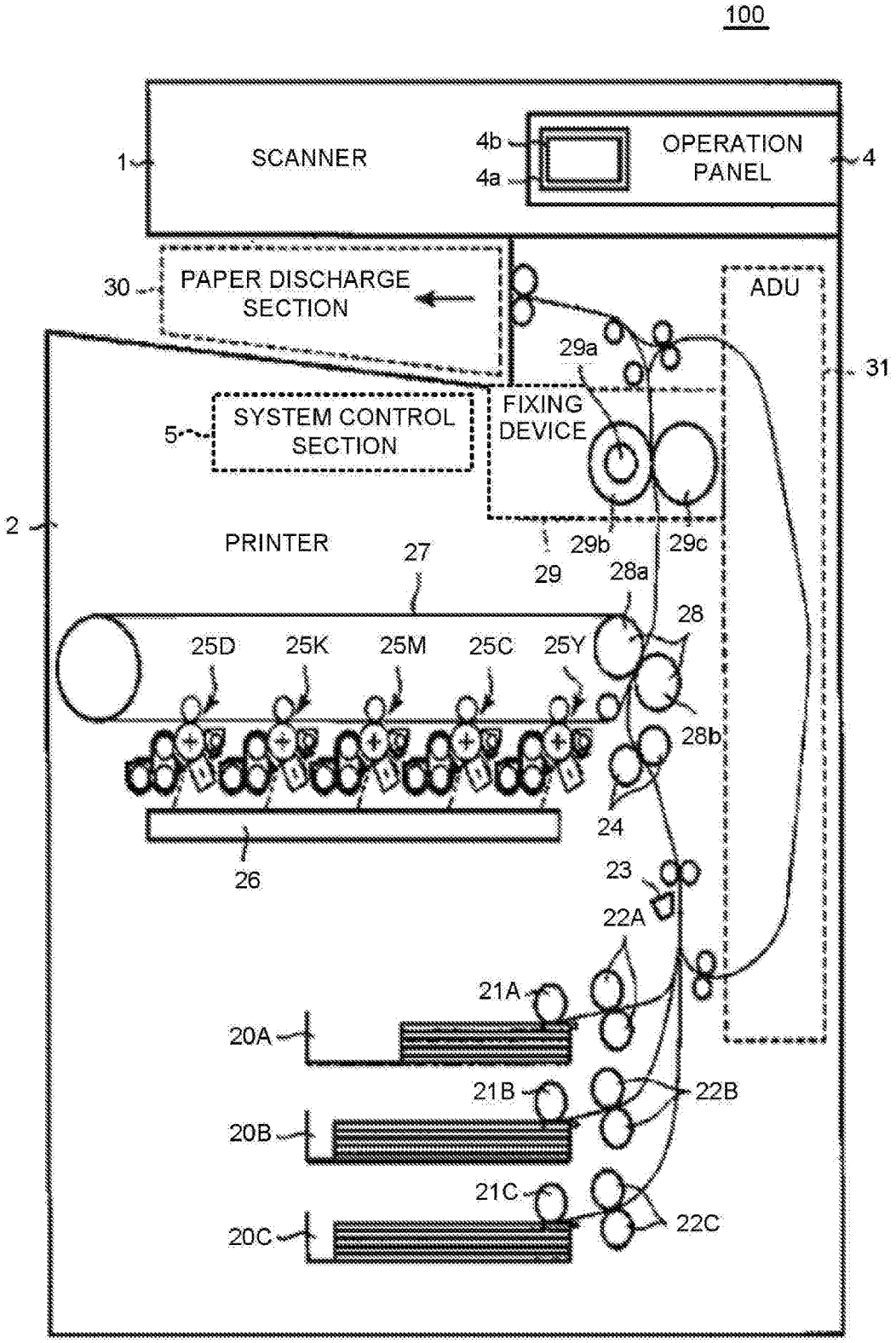
FIG. 1 is a cross-sectional view schematically illustrating an image forming apparatus according to a first embodiment and a second embodiment.

The first embodiment is described with reference to FIG. 1 to FIG. 13. FIG. 1 is a cross-sectional view schematically illustrating an MFP 100 according to the first embodiment. The MFP 100 according to the first embodiment functions as the image forming apparatus. The MFP 100 shown in FIG. 1 includes a scanner section 1, a printer section 2, an operation panel 4 and a system control section 5.

The scanner section 1 reads an image of a document to convert the image to image data. The scanner section 1 has the well-known configuration equipped with, for example, a CCD line sensor which converts the image of the document on a reading surface to the image data. The scanner section 1 may scan the document placed on a document table glass (not shown) or read the image of the document conveyed by an ADF (Auto Document Feeder). The scanner section 1 is arranged on the upper side of a main body of the MFP 100, for example. The scanner section 1 is controlled by the system control section 5.

The printer section 2 forms an image on a sheet as an image receiving medium. In the present embodiment, the printer section 2 is an electrophotographic type image forming section. The printer section 2 forms the image with the use of five of plural types of toner (for example, yellow (Y) toner, cyan (C) toner, magenta (M) toner, black (K) toner and decoloring (D) toner, although any number of toners can be employed). The yellow (Y) toner, the cyan (C) toner, the magenta (M) toner and the black (K) toner are non-decolorable toner which cannot be decolored even if they are heated at a predetermined or higher fixing temperature. The decoloring toner (D) is decolorable toner which can be decolored through heating at a predetermined or higher temperature exceeding the fixing temperature. The color of the decoloring toner (D) is, for example, dark blue. Furthermore, details of the well-known configuration for carrying out generation of the image by the printer section 2 are described later.

The decoloring toner used in the embodiment is formed by including a color material in binder resin, for example. The decolorable color material contains a color generation compound, a developer and a decoloring agent. As the color generation compound, for example, leuco dye is exemplified. As the developer, for example, phenols are exemplified. As the decoloring agent, a substance which is blended with the color generation compound if heated and does not have affinity to the developer is exemplified. The decolorable color material develops the color through interaction of the color generation compound and the developer, and can be decolored as the interaction of the color generation compound and the developer is cut off through the heating at a temperature equal to or higher than a decoloring temperature.

In the configuration example shown in FIG. 1, the printer section 2 includes a paper feed cassette 20 (20A, 20B and 20C) as a paper feed section. For example, each of the paper feed cassettes 20A, 20B and 20C is arranged at the lower part of the main body of the MFP 100 in a detachable state. These paper feed cassettes 20A, 20B and 20C respectively store sheets with different types (for example, different sizes and/or paper qualities) set respectively. It is also possible to set each of these paper feed cassettes 20A, 20B and 20C to a paper feed cassette corresponding to each size after the sheets with different sizes are respectively housed in the paper feed cassettes 20A, 20B and 20C, for example. A paper feed section sensor (not shown) is arranged in each of the paper feed cassettes 20A, 20B and 20C. The paper feed section sensor detects the number of the sheets housed in a paper feed tray. The paper feed section sensor is, for example an infrared sensor. In addition, a mechanical sensor can also be used in which a well-known micro switch is arranged. The paper feed section sensor sends a detection result to a system control section 5 described later. Further, the printer section 2 may include a manual feed tray (not shown) as another paper feed section.

Setting information relating to the sheets housed by each of the paper feed cassettes 20A, 20B and 20C is stored in a non-volatile memory. The printer section 2 selects a paper feed cassette that houses sheets to be used in a printing processing according to the setting information. The printer section 2 prints an image on the sheet fed from the selected paper feed cassette. Furthermore, in a case in which the printer section 2 includes the manual feed tray, a size of a sheet set in the manual feed tray, which is input from the operation panel 4, may be stored in the foregoing non-volatile memory.

Furthermore, in the following description, as the sheet is conveyed from the paper feed section 20 to a paper discharge section 30, the paper feed section 20 side is regarded as the upstream side with respect to a sheet conveyance direction, and the paper discharge section 30 side is regarded as the downstream side with respect to the sheet conveyance direction.

A conveyance section 22 shown in FIG. 1 conveys the sheet in the printer section 2. The conveyance section 22 conveys the sheet supplied from the corresponding paper feed cassette 20A, 20B or 20C through a pickup roller 21A, 21B or 21C to a resist roller 24. The resist roller 24 conveys the sheet to a transfer position at the timing when the image is transferred onto the sheet from an intermediate transfer belt 27 described later.

Hereinafter, details of the image formation are described. As shown in FIG. 1, the image forming section 25, an exposure section 26, the intermediate transfer belt 27 and a transfer section 28 function as well-known image forming modules for forming an image. The image forming section 25 forms the image to be transferred onto the sheet. The configuration example of generating a color image shown in FIG. 1 is described in detail later; however, an image forming section 25Y forms an image corresponding to yellow with the yellow toner by color-separating a document image. An image forming section 25M forms an image with the magenta toner similarly. An image forming section 25C forms an image with the cyan toner. An image forming section 25K forms an image with the black toner. Then, each of the image forming sections 25Y, 25M, 25C and 25K overlaps and transfers the toner image of each color onto the intermediate transfer belt 27. On the other hand, the image forming section 25D forms an erasable document image used in a case in which the sheet is reused with the decolorable toner. As stated above, the color of the decolorable toner is the dark blue. Thus, the image formed by the image forming section 25D is a monochrome image. Each of the image forming sections 25Y, 25M, 25C, 25K and 25D includes the well-known configuration constituted by, for example, a photoconductive drum, a charging charger, a developing section containing the toner, a charge removing section and the like (only shown in FIG. 1).

Each of the image forming sections 25Y, 25M, 25C, 25K and 25D includes a well-known sensor such as a potential sensor and a density sensor (neither is shown). The potential sensor detects surface potential of the well-known photoconductive drum included in each image forming section. In each of the image forming sections 25Y, 25M, 25C, 25K and 25D, the well-known charging charger charges the surface of the photoconductive drum before the photoconductive drum is exposed by the exposure section 26 described later. The system control section 5 can change a charging condition of the charging charger. The potential sensor detects the surface potential of the photoconductive drum of which the surface is charged by the charging charger. The density sensor detects density of the toner image transferred onto the intermediate transfer belt 27 described later. Further, the density sensor may detect density of the toner image formed on the photoconductive drum.

The exposure section 26 forms an electrostatic latent image of the document image acquired by the scanner section 1 on the charged photoconductive drum of each of the image forming sections 25Y, 25M, 25C, 25K and 25D through laser light as stated above. The electrostatic latent image formed on each photoconductive drum is an image to be developed with toner of each color. In other words, the exposure section 26 emits the laser light corresponding to each image forming section controlled according to the image data to each photoconductive drum via an optical system such as a polygon mirror. The exposure section 26 controls power of the laser light according to a control signal from the system control section 5. The exposure section 26 also controls a modulation amount of a pulse width for controlling emission of the laser light according to a control signal from the system control section 5.

As stated above, each of the image forming sections 25Y, 25M, 25C, 25K and 25D develops the electrostatic latent image formed on the individual photoconductive drum with the toner of each color by the developing section. Each of the image forming sections 25Y, 25M, 25C, 25K and 25D forms the toner image as a visible image on the photoconductive drum. The intermediate transfer belt 27 is an intermediate transfer body. In a case in which the color image is formed with the foregoing non-decolorable toner, each of the image forming sections 25Y, 25M, 25C and 25K transfers (primarily transfers) the toner image formed on the photoconductive drum onto the intermediate transfer belt 27. Specifically, each of the image forming sections 25Y, 25M, 25C and 25K applies transfer bias to the toner image at a primary transfer position. Each of the image forming sections 25Y, 25M, 25C and 25K controls the transfer bias through a transfer current. The toner image on each photoconductive drum is transferred onto the intermediate transfer belt 27 through the transfer bias at the individual primary transfer position (for example, a portion where the photoconductive drum is contacted with the transfer belt). The system control section 5 controls the transfer current used in a primary transfer processing by the image forming section. On the other hand, in a case in which the sheet is reused, in other words, in a case in which the monochrome image with the decolorable toner is formed, the toner image as the visible image is formed on the photoconductive drum by the image forming section 25D. The toner image is transferred onto the intermediate transfer belt 27 as stated above.

The transfer section 28 transfers the toner image on the intermediate transfer belt 27 onto the sheet at a secondary transfer position. The transfer section 28 includes a support roller 28*a* and a secondary transfer roller 28*b* arranged along a conveyance path of the sheet, and the secondary transfer position is a position where the support roller 28*a* and the secondary transfer roller 28*b* are opposite to each other across the intermediate transfer belt 27. The transfer section 28 applies the transfer bias controlled by the transfer current to the intermediate transfer belt 27 at the secondary transfer position. The transfer section 28 transfers the toner image on the intermediate transfer belt 27 onto the sheet through the transfer bias. The system control section 5 controls the transfer current used in a secondary transfer processing.

A fixing device 29 arranged at the downstream side of the foregoing transfer section 28 has a function of enabling the toner to be fixed on the sheet. For example, in the embodiment, the fixing device 29 enables the toner image to be fixed on the sheet through heat and pressure applied to the sheet.

In the configuration example of FIG. 1, the fixing device 29 is composed of a heat roller (heating section) 29*b* in which a heating source 29*a* is built and a pressure roller (pressure section) 29*c* contacting therewith in a pressure state through a pressure mechanism (not shown). The heating source 29*a* may be a heater capable of controlling a temperature. For example, the heating source 29*a* may be constituted by a heater lamp such as a halogen lamp or may be an induction heating (IH) heater. Further, the heating source 29*a* may be constituted by a plurality of heaters. Furthermore, the fixing device 29 includes a temperature sensor (not shown) for measuring the temperature of the heat roller 29*b*. The temperature sensor sends the temperature of the heat roller 29*b* to the system control section 5 described later. The pressure mechanism presses the pressure roller 29*c* to the heat roller 29*b*. The pressure mechanism is constituted by an elastic member. In a case in which the pressure roller 29*c* is not pressed to the heat roller 29*b* by the pressure mechanism, the pressure roller 29*c* and the heat roller 29*b* are separated from each other, and a gap is formed between the pressure roller 29*c* and the heat roller 29*b*.

In a case of carrying out a fixing processing of enabling the toner image to be fixed on the sheet, the system control section 5 carries out control in such a manner that the temperature of the fixing device 29 becomes a predetermined fixing temperature. The fixing device 29 pressures the sheet on which the toner image is transferred by the transfer section 28 and heats the sheet at the fixing temperature. In this way, the fixing device 29 enables the toner image to be fixed on the sheet. Through a well-known branching mechanism (not shown) arranged at the downstream side of the fixing device 29, the sheet to which the fixing processing is carried out is conveyed to either the paper discharge section 30 or an ADU (Automatic Duplex Unit) 31 in response to a processing request of a user.

In a case in which the sheet to which the fixing processing is carried out by the fixing device 29 is discharged, the sheet is conveyed to the paper discharge section 30. Further, in a case in which the image is also formed on the back surface of the sheet to which the fixing processing is carried out by the fixing device 29, the sheet is switched back and then conveyed to the ADU 31 after temporarily conveyed to the paper discharge section 30 side. In this case, the ADU 31 supplies the sheet reversed through the switchback to the upstream side of the resist roller 24 again.

The operation panel 4 is a user interface. The operation panel 4 includes well-known various input buttons and a display section 4*a* equipped with a touch panel 4*b*. The system control section 5 controls contents displayed on the display section 4*a* of the operation panel 4. The operation panel 4 outputs information input through the touch panel 4*b* or the input button of the display section 4*a* to the system control section 5. Further, the operation panel 4 receives the input of information such as the number of printing sheets and density necessary for the printing at the time of the printing. An operator operates the operation panel 4 to select either a normal printing mode in which the printing is carried out with the non-decolorable toner or a part decoloring toner mode in which the printing is carried out with the decolorable toner and the non-decolorable toner. The operation panel 4 further includes a normal printing mode key (not shown) and a part erasing key (not shown). In a case of selecting the normal printing mode, the operator presses the normal printing mode key, and in a case of selecting the part decoloring toner mode, the operator presses the part erasing key.

Figure 2:
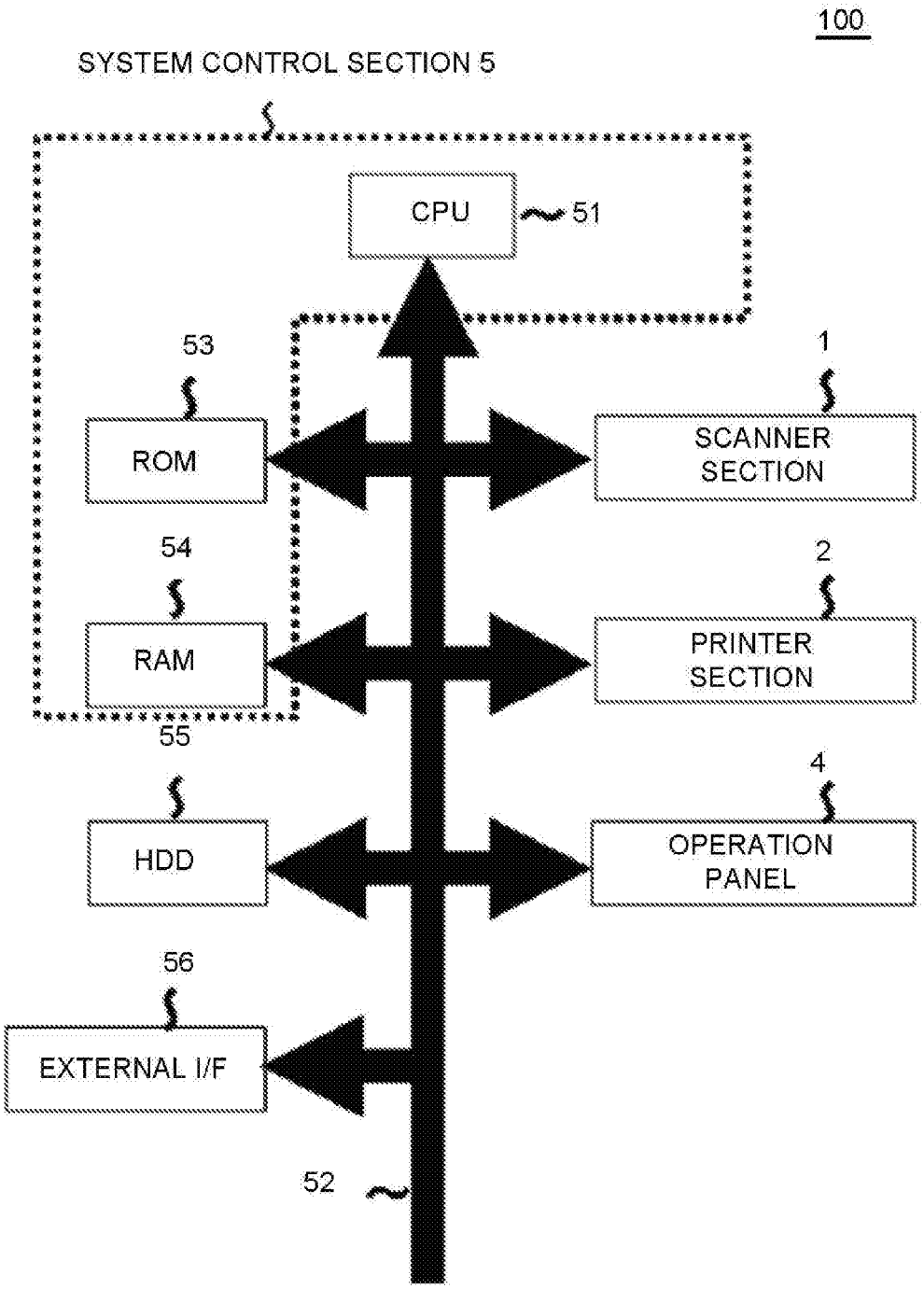
FIG. 2 is a block diagram illustrating the image forming apparatus according to the first embodiment and the second embodiment.

Next, the configuration of a control system of the MFP 100 is described. FIG. 2 is a block diagram illustrating the MFP 100 of the present embodiment. A CPU (Central Processing Unit) 51, a ROM (Read Only Memory) 53, a RAM (Random Access Memory) 54, an HDD (Hard Disk Drive) 55, an external I/F (Interface) 56, the scanner section 1, the printer section 2 and the operation panel 4 are connected with one another via a system bus line 52. The CPU 51, the ROM 53 and the RAM 54 constitute the system control section 5.

A program executed by the CPU 51 and a threshold value are stored in the ROM 53 in advance. For example, the fixing temperature at which the fixation of the decolorable toner or the non-decolorable toner is possible is also stored the ROM 53.

Figure 6:
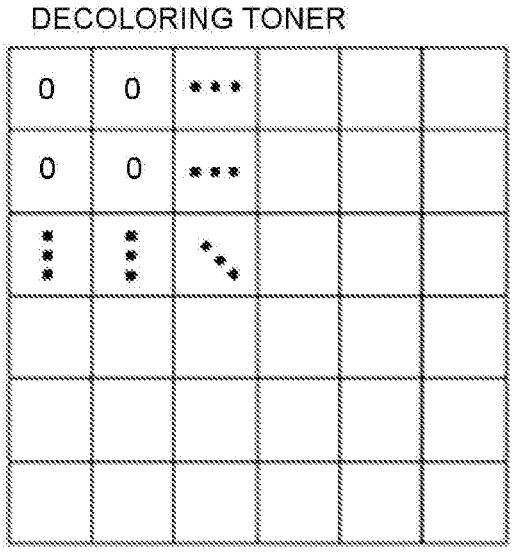
FIG. 6 is a diagram schematically illustrating a bitmap image according to the first embodiment.

In the RAM 54, various memory areas such as an area in which a program executed by the CPU 51 is copied or decompressed and a working area serving as a job area of a data processing based on the program are dynamically formed. Further, the RAM 54 includes a temporary storage area for temporarily storing the image information of the document read by the scanner section 1 (the temporary storage area is equivalent to a first storage section). The image information has a bitmap image for each color of each toner to be used in the printing. As shown in FIG. 5 and FIG. 6, the bitmap image divides the image information into a plurality of areas for each toner and has information indicating whether or not the toner is used in each area. In the present embodiment, there are the bitmap images of, for example, five types of toner including the yellow (Y) toner, the cyan (C) toner, the magenta (M) toner, the black (K) toner and the decoloring (D) toner. "1" meaning that the toner serving as an object is used in the area, and "0" meaning that the toner is not used in the area. A primary transfer is carried out on the basis of the bitmap image of each toner.

The HDD 55 is a high capacity storage device. An OS (Operating System) for enabling the MFP 100 to operate is installed. In the HDD 55, an emphasis information candidate file 55*a* shown in FIG. 7 and an emphasis information storage file 55*b* shown in FIG. 8 are stored. In the emphasis information candidate file 55*a*, emphasis information indicating an object to be printed with the decolorable toner is stored at the time the part decoloring toner mode is selected. The emphasis information indicates, for example, bold type, underline, red character, number, italic, color painting, hatching and the like. The object indicated by the emphasis information is printed with the use of the decolorable toner. For example, in the document C as shown in FIG. 10, the characters of "B" represented by bold type and the characters of "C" represented by the underline are printed with the decolorable toner.

Further, the emphasis information candidate file 55*a* is composed of an emphasis information column and an identifier column. The emphasis information column and the identifier column are a one-to-one relationship. The emphasis information is stored in the emphasis information column, and an identifier corresponding to the emphasis information is stored in the identifier column. The system control section 5 carries out management of the emphasis information through the identifier.

In a case in which the part decoloring toner mode is selected, the system control section 5 refers to the emphasis information candidate file 55*a* to display the emphasis information stored in the emphasis information column of the emphasis information candidate file 55*a* and corresponding check boxes 4*a* on the operation panel 4. A completion key 4*b* is displayed at the lower side of the operation panel 4. If the check box 4*a* is checked and the completion key 4*b* is pressed by the operator, the system control section 5 reads out the emphasis information and the identifier corresponding to the checked check box 4*a* from the emphasis information candidate file 55*a* to store the read emphasis information and the identifier in the emphasis information storage file 55*b*. The emphasis information storage file 55*b* which has the same structure as the foregoing emphasis information candidate file 55*a* includes the emphasis information column and the identifier column. The emphasis information checked by the check box 4*a* is stored in the emphasis information storage file 55*b*. It is determined whether or not the emphasis information exists in the image information temporarily stored in the RAM 54 on the basis of the emphasis information stored in the emphasis information storage file 55*b* (the emphasis information storage file 55*b* is equivalent to a second storage section).

The external I/F 56 is an interface for realizing communication of the system control section 5 with an external device. For example, the external I/F 56 receives print data in response to a print request from the external device, for example, a client terminal (PC). The external I/F 56 may be an interface for carrying out data communication with the external device, for example, may be a device (USB memory) locally connected with the external device or may be a network interface for realizing communication via a network. The external I/F 56 is equivalent to a communication section.

As the scanner section 1, the printer section 2 and the operation panel 4 are described above, the description thereof is omitted.

Figure 3:
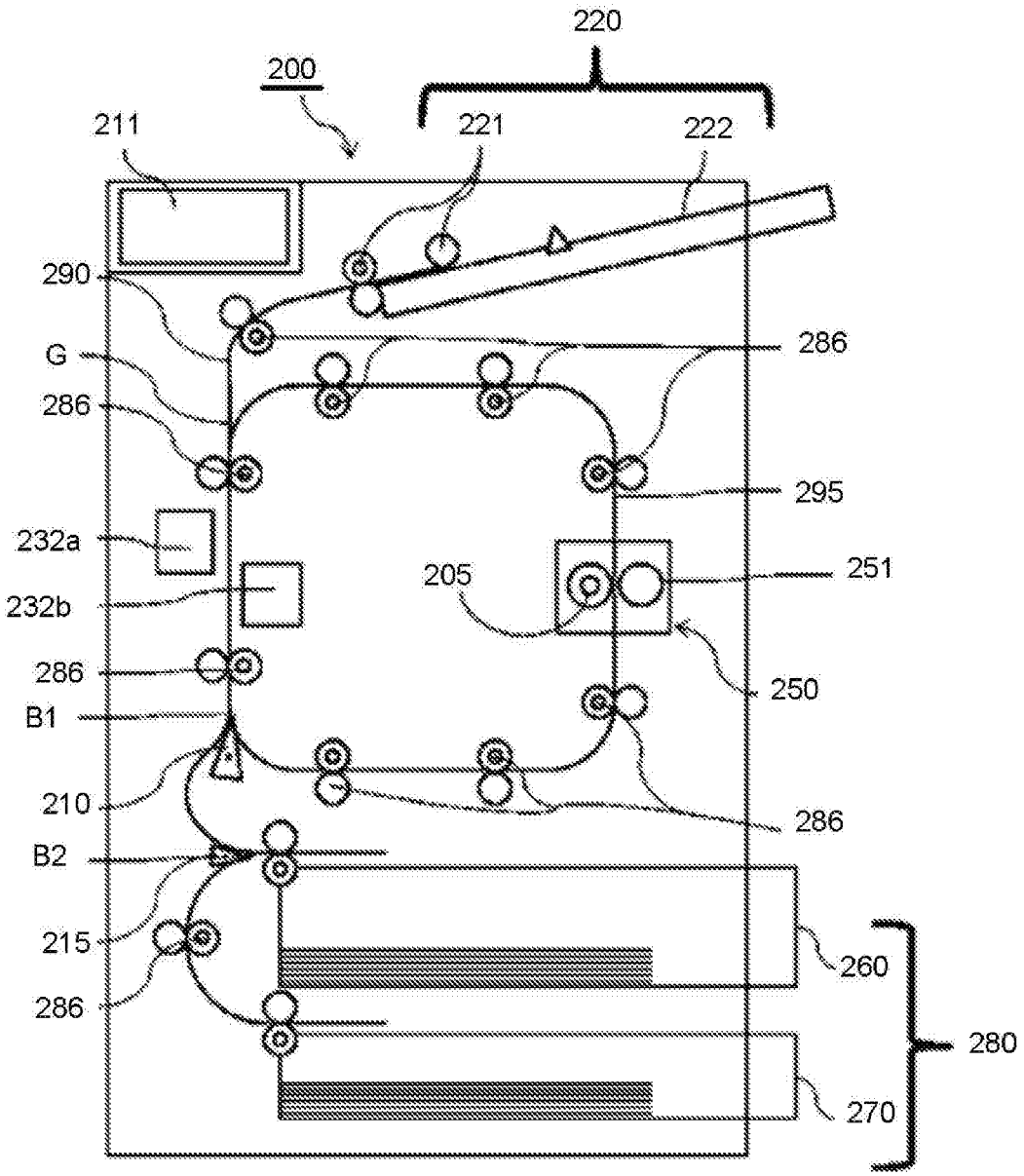
FIG. 3 is a diagram schematically illustrating an image erasing apparatus according to the first embodiment and the second embodiment.

Next, an image erasing apparatus 200 is described. FIG. 3 is a schematic cross-sectional view of the image erasing apparatus 200 according to the present embodiment. The image erasing apparatus 200 erases an image of a sheet P as the image receiving medium on which the image is already formed to enable the sheet P to be reused. In the present embodiment, an erasing processing of decoloring the recording material through the heating and thus erasing the image is described as an example of the erasing processing.

The image erasing apparatus 200 shown in FIG. 3 includes a paper feed section 220 for housing the sheet P on which the image to be erased is printed, a first conveyance path 290 and a second conveyance path 295 for conveying the sheet P, a first reading section 232*a* and a second reading section 232*b* for reading the image of the sheet P, an erasing section 250 for decoloring the recording material used for forming the image of sheet P, conveyance rollers 286 arranged in each conveyance path, a first route change section 210 for switching a conveyance route of the sheet P, a paper discharge section 280 composed of a first paper discharge section 260 and a second paper discharge section 270 for storing the sheets P to which the processing is completed, and a second route change section 215 arranged in the first conveyance path 290 for switching the routes between the first paper discharge section 260 and the second paper discharge section 270. The combination of the first conveyance path 290, the second conveyance path 295 and the conveyance roller 286 is equivalent to a conveyance section.

The paper feed section 220 houses the sheet P to be reused, on which the image is already formed. The sheet P is fed to the inside of the image erasing apparatus 200 in order to erase the image of the sheet P. The sheet P to be reused is a sheet P on which an image is formed with the toner capable of being decolored through the heating as the recording material. Further, the sheets P may have various sizes such as A3, A4, B5 and the like. The sheet feed section 220 includes a sheet feed tray 222 and a pickup roller 221 (hereinafter, referred to as a sheet feed tray pickup roller) for picking up the sheet P in the sheet feed tray 222. The sheet feed tray 222 stacks the sheet P to which the erasure of the image is carried out. The sheet feed tray pickup roller 221 picks up the sheets P one by one from the sheet feed tray 222 to send the sheets P to the first conveyance path 290 in order. Further, a sheet feed section sensor (not shown), arranged in the sheet feed section 220, is used to detect whether or not the sheet P exists in the sheet feed tray 222. The sheet feed section sensor is, for example, an infrared sensor. In addition, a sensor using a well-known micro switch can also be used. The sheet feed section sensor sends a detection result to a control section 250 described later.

The first conveyance path 290 and the second conveyance path 295 include a plurality of the conveyance rollers 286. Each conveyance roller 286 is composed of a pair of a driving roller and a driven roller.

The first reading section 232*a* and the second reading section 232*b* are arranged in the first conveyance path 290 along the conveyance path. The first conveyance path 290 conveys the sheet P from the sheet feed section 220 to the sheet discharge section 280 through the conveyance roller 286 via the first reading section 232*a* and the second reading section 232*b*.

In the present embodiment, as the sheet P is conveyed from the sheet feed section 220 to the sheet discharge section 280, the sheet feed section 220 side is regarded as the upstream side with respect to the conveyance direction of the sheet P, and the sheet discharge section 280 side is regarded as the downstream side with respect to the conveyance direction of the sheet P.

The first reading section 232*a* and the second reading section 232*b* each include, for example, a two-dimensional CCD scanner (the combination of the first reading section 232*a* and the second reading section 232*b* is equivalent to a reading section). The two reading sections 232*a* and 232*b*, for example, are arranged at mutually different positions across the first conveyance path 290. According to such a configuration, the first reading section 232*a* reads one side of the conveyed sheet P, and the second reading section 232*b* reads the other side opposite to the side read by the first reading section 232*a*. The images read by the first reading section 232*a* and the second reading section 232*b*, for example, are properly stored in an HDD 212 described later.

The first conveyance path 290 is connected to the sheet discharge section 280 via a branch point B1 positioned at the downstream side of the first reading section 232*a* and the second reading section 232*b* in the conveyance direction of the sheet P. As shown in FIG. 3, the second conveyance path 295 is connected with the branch point B1, and the first route change section 210 for switching the routes between the first conveyance path 290 and the second conveyance path 295 is arranged at the branch point B1. For example, it is set by default that the first route change section 210 allows the route for conveying the sheet P from the sheet feed section 220 to the sheet discharge section 280 via the first reading section 232*a* and the second reading section 232*b*.

In addition, the first conveyance path 290 is connected to the first paper discharge section 260 or the second paper discharge section 270 via a branch point B2 located at the downstream side of the branch point B1. The second route change section 215 is connected with the branch point B2 as shown in FIG. 3. It is set by default that the second route change section 215 allows the route for conveying the sheet P from the first route change section 210 to the first sheet discharge section 260.

In the present embodiment, a reusable sheet is conveyed to the first paper discharge section 260, and a sheet which is unsuitable to be reused due to a reason such as dirt and the like is conveyed to the second paper discharge section 270.

The second conveyance path 295 is branched from the first conveyance path 290 at the branch point B1 and merged with the first conveyance path 290 at a merging point G positioned at the upstream side of the first reading section 232*a* and the second reading section 232*b* in the first conveyance path 290 and at the downstream side of the sheet feed section 220.

The erasing section 250 is arranged in the second conveyance path between the branch point B1 and the merging point G of the first conveyance path 290 and the second conveyance path 295. The erasing section 250 includes a roller pair 251 and a heater 205 serving as a heating source. The heater 205, for example, is arranged in at least one of rollers constituting the roller pair 251. The roller pair 251 is heated by the heater 205. In this way, in the erasing section 250, through the heater 205, the image of the sheet P formed with the decolorable toner is heated to the decoloring temperature (target temperature) via the roller pair 251 and the toner used for forming the image is decolored. Further, though not shown, a temperature sensor is arranged in the vicinity of the roller pair 251. The temperature sensor measures the temperature of the roller pair 251 and sends a measured result to a control section 250 described later.

Figure 4:
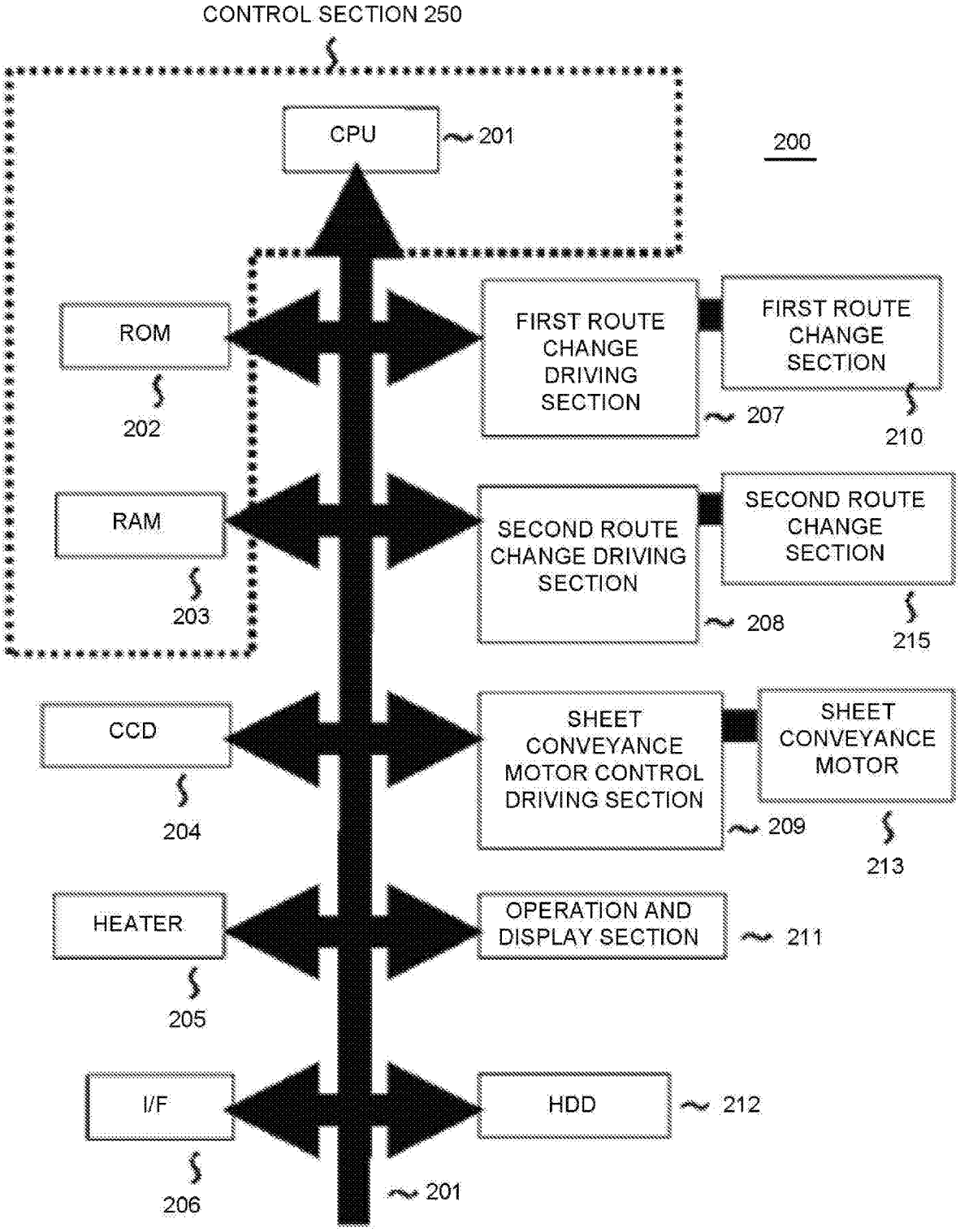
FIG. 4 is a block diagram illustrating the image erasing apparatus according to the first embodiment and the second embodiment.

FIG. 4 is a block diagram of the image erasing apparatus 200. A CPU (Central Processing Unit) 201, a ROM (Read Only Memory) 202, a RAM (Random Access Memory) 203, CCD sensors 204 constituting the first reading section 232*a* and the second reading section 232*b*, the heater 205 of the erasing section 250, an interface (I/F) 206 for carrying out data input and output with an external device such as a client terminal, a first route change driving section 207 for controlling the first route change section 210, a second route change driving section 208 for controlling the second route change section 215, a sheet conveyance motor 213 for driving various rollers, a sheet conveyance motor control driving section 209 for controlling the sheet conveyance motor 213, an operation and display section 211 for carrying out the input and the display of various setting and the HDD 214 are connected with one another via a system bus line 201. The CPU 201, the ROM 202 and the RAM 203 constitute the control section 250.

The ROM 202 stores a program executed by the CPU 201 of the control section 250. The ROM 202 further stores a threshold value of a printing rate of the image of the sheet and a threshold value of a density of the image of the sheet. The control section 250 determines whether or not the erasure is normally carried out on the basis of the two threshold values. In other words, the control section 250 determines whether or not the sheet can be reused.

In the RAM 203, various memory areas such as a working area serving as a job area of a data processing according to the program are dynamically formed.

The CCD sensors 204 constituting the reading sections 232*a* and 232*b* are arranged as a row of line sensors (two-dimensional scanners) for reading the images of the sheet P to detect intensity of the surface of the sheet P with the conveyance of the sheet P. The CCD sensor 204 detects the intensity of the surface of the sheet P to read out or detect the image. The reading section 232 is not limited to the CCD sensor and may be a CMOS sensor.

The heater 205 of the erasing section 250 uses, for example, an induction heating (IH) heater. As stated above, while the sheet P passes through the erasing section 250, via the roller pair 251, the heat from the heater 205 is indirectly applied to the sheet P to discolor the toner used for forming the image. The heater 205 may be optional as long as it can control the temperature. In addition to the induction heating heater, for example, a lamp heater such as a halogen lamp or infrared heater may be used.

The operation and display section 211 which is, for example, a touch panel carries out the display and the input of information relating to operations of the image erasing apparatus 200. In addition, the operation and display section 211 is an input section that includes various setting and instruction keys and inputs various operations. In a case of carrying out the erasure of the image, the operator operates a touch panel of the operation and display section 211. For example, the operator presses a setting and instruction key (not shown) arranged on the touch panel to carry out the setting of the erasure in advance. In the present embodiment, in the erasing processing of the image, the sheet P is conveyed to the erasing section 250 after all the images of sheet P are read by the first reading section 232*a* and the second reading section 232*b*. Then, the sheet P is discharged to the discharge section 280 after the sheet P is erased by the erasing section 250. Furthermore, the operation and display section 211 includes a start key (not shown) for starting the erasing processing of the image.

The control section 250 controls the first route change driving section 207 to drive the first route change section 210 to switch the position set by default to execute distribution so that the sheet P is conveyed from the first conveyance path 290 to the second conveyance path 295.

Further, the control section 250 controls the second route change driving section 208 to drive the second route change section 215 to distribute the sheet P to the first sheet discharge section 260 or the second sheet discharge section 270.

The HDD 212 at least includes a read image storage area for storing the image read by the CCD sensor 204 for the first time and a redetermination storage area for storing the image of the sheet to which the erasing processing is carried out by the erasing section 250.

Figure 9:
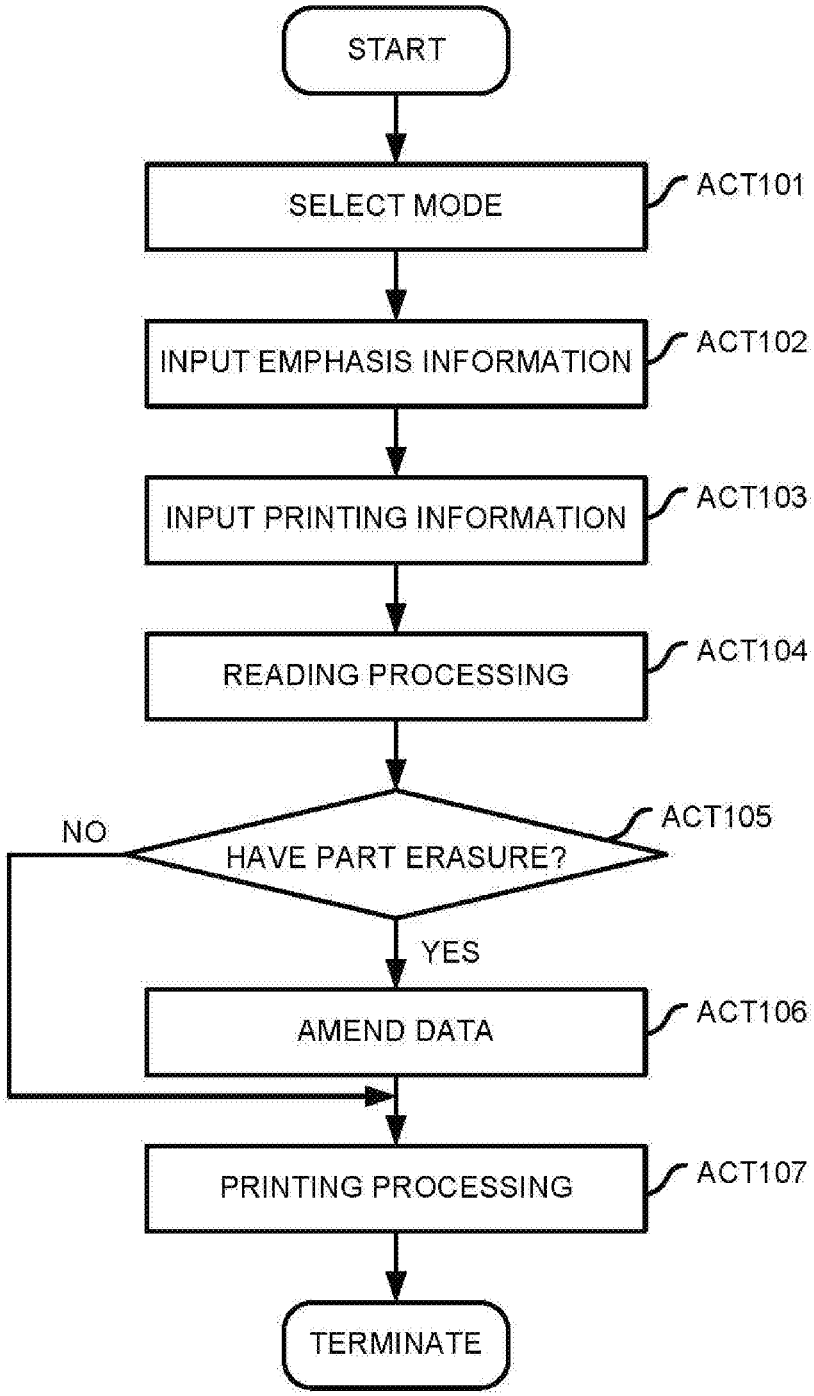
FIG. 9 is a flowchart illustrating a process of a print job according to the first embodiment.
Figure 12:
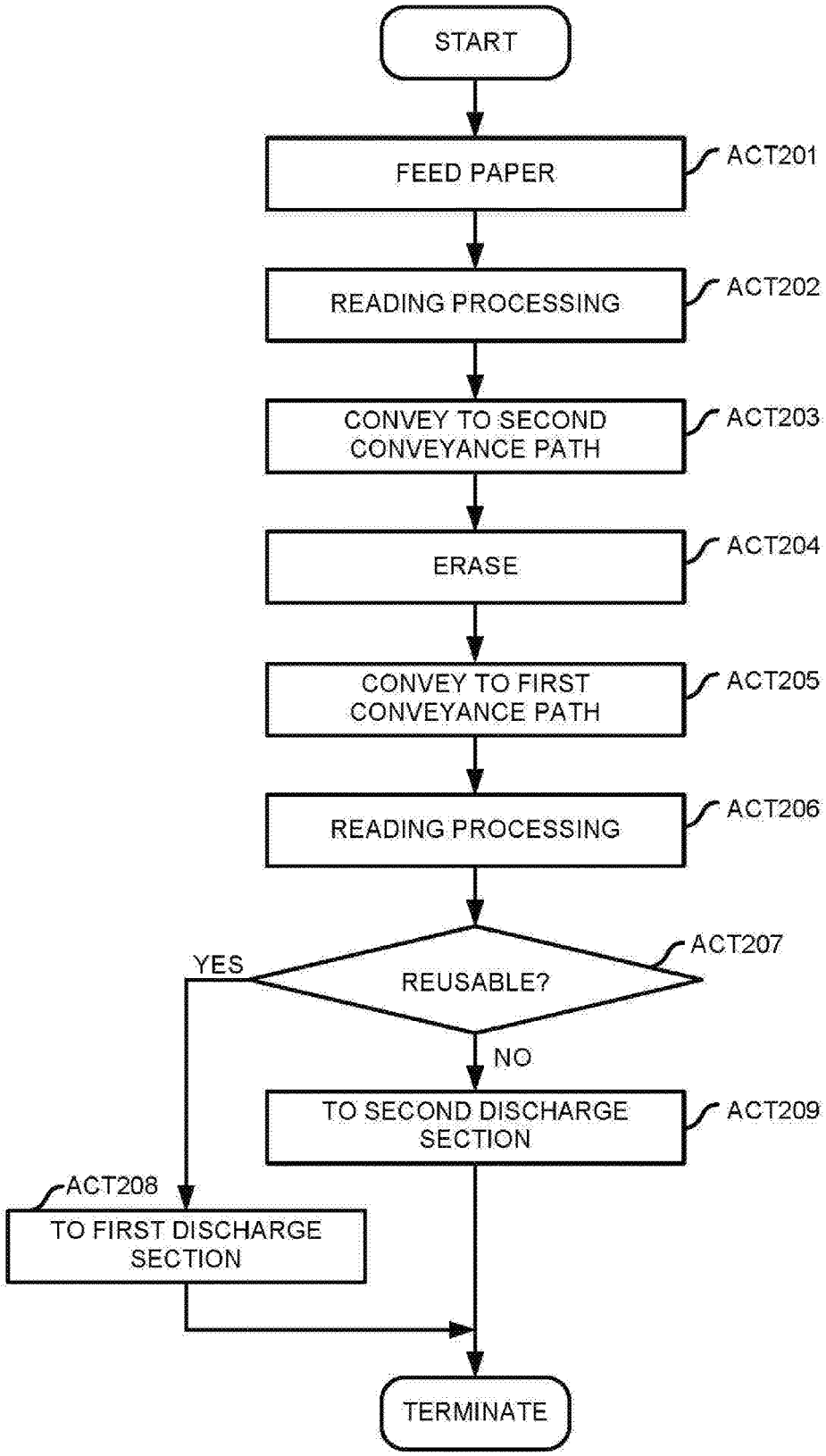
FIG. 12 is a flowchart illustrating a process of an erasing job according to the first embodiment.

In the MFP 100 and the image erasing apparatus 200 with the foregoing configurations, on the basis of the preset programs, the MFP 100 carries out the print job as shown in FIG. 9, and the image erasing apparatus 200 carries out the erasing job as shown in FIG. 12.

Firstly, the print job carried out by the MFP 100 is described. At this time, the document C shown in FIG. 10 is placed on the document table glass of the scanner section 1. The MFP 100 reads the document C to copy it. As stated above, the characters of "B" in bold type and the characters of "C" with underline are recorded on the document C. The operator operates the operation panel 4 to press the part erasing key to copy the document C in the part decoloring toner mode. Further, the operator selects that the characters marked by bold type and underline are printed with the decolorable toner.

The system control section 5 receives the input of a key signal of a part decoloring toner mode key through the operation panel 4 (ACT S101).

Figure 11:
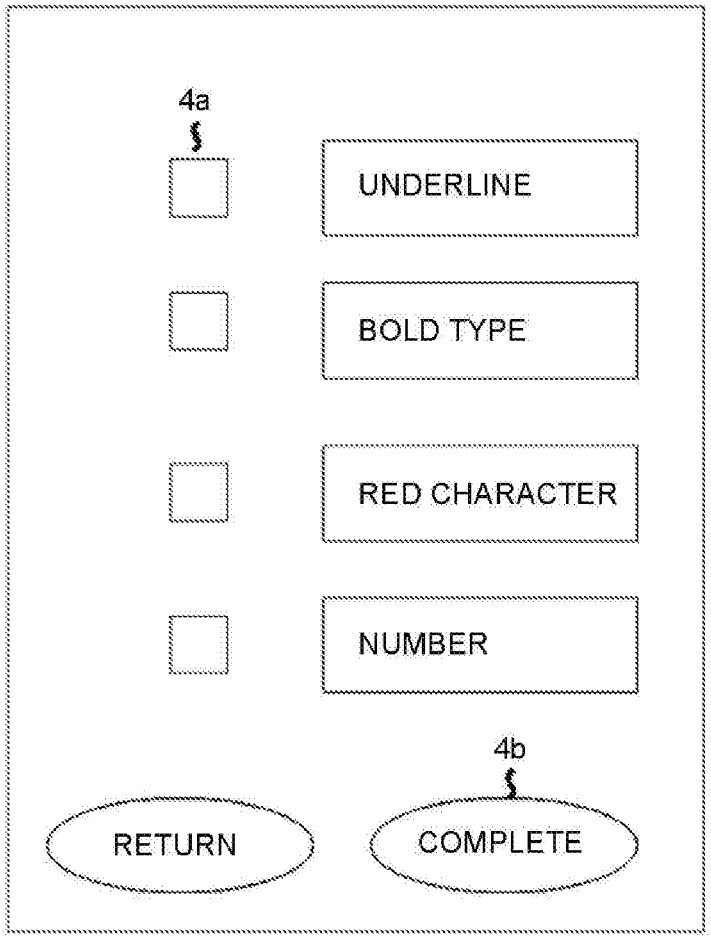
FIG. 11 is a diagram illustrating a display example of a screen displayed on an operation panel according to the first embodiment.

If the key signal of the part decoloring toner mode key is input, the system control section 5 displays the emphasis information stored in the emphasis information candidate file 55*a* of the HDD 55 on the operation panel 4 as shown in FIG. 11. Then, a random check is input to the check box 4*a* of the displayed emphasis information through the operation panel 4. In the present embodiment, the checks are input to the check boxes of the underline and the bold type by the operator. Then, if a key signal of the completion key 4*b* is input to the system control section 5, the system control section 5 reads out the selected emphasis information and the identifier from the emphasis information candidate file 55*a* to store the emphasis information and the identifier in the emphasis information storage file 55*b*. In the present embodiment, the underline and the bold type are stored in the emphasis information column, and 0001 and 0002 serving as the identifiers of the underline and the bold type are stored in the corresponding identifier column (ACT S102).

Subsequently, the system control section 5 receives the input of printing information such as the number of printing sheets and printing magnification through the operation panel 4. The input printing information is stored in a predetermined area of the RAM 54 (ACT S103).

The system control section 5 receives the input of a key signal of a start key through the operation panel 4. The system control section 5 that receives the input of the key signal enables the scanner section 1 to operate to scan the document C placed on the document table glass. The system control section 5 stores the read image information of the document C in the temporary storage area of the RAM 54 (ACT S104).

Then, the system control section 5 determines whether or not the emphasis information stored in the emphasis information storage file 55*b* of the HDD 55 is stored in the image information stored in the temporary storage area of the RAM 54. The determination is carried out in such a manner that the system control section 5 uses OCR (Optical Character Reader) software or carries out various processing such as macro recognition or micro recognition on the image information stored in the temporary storage area of the RAM 54 to analyze the image information stored in the temporary storage area of the RAM 54. Then, the system control section 5 compares the analysis result with the content in the emphasis information storage file 55*b* of the HDD 55 to determine whether or not the emphasis information is recorded in the image information stored in the temporary storage area of the RAM 54. In the present embodiment, the system control section 5 retrieves the characters recorded with underline and bold type from the image information stored in the temporary storage area of the RAM 54 (ACT S105).

If the system control section 5 determines that no emphasis information is recorded (No in ACT S105), the image information stored in the temporary storage area of the RAM 54 is printed according to the printing information (the number of printing sheets and the printing magnification) stored in the RAM 54 (ACT S107) and then the processing is terminated.

On the other hand, if the system control section 5 determines that the emphasis information stored in the emphasis information storage file 55*b* of the HDD 55 is recorded (Yes in ACT S105), in order to print the object indicated by the emphasis information with the decolorable toner, the bitmap image stored in the temporary storage area of the RAM 54 is rewritten. Specifically, the object (image information) printed with the decolorable toner as used in ACT S105 described above is specified by the OCR software, the macro recognition or the micro recognition. Then, in the bitmap images as shown in FIG. 5 and FIG. 6, areas serving as the objects of the cyan toner, the magenta toner, the yellow toner and the black toner are rewritten from "1" to "0" and an area serving as the object of the decolorable toner is rewritten from "0" to "1". In the present embodiment, the bitmap image is changed in such a manner that the characters "B" formed in bold type and the characters "C" with underline are printed with the decolorable toner (ACT S106).

After that, the printer section 2 is used to print the image information stored in the temporary storage area of the RAM 54 according to the printing information stored in the RAM 54 (ACT S107), and then the processing is terminated. Through these processing, on the sheet P serving as a copy of the document C shown in FIG. 10, the characters "B" and the characters "C" are printed with the decolorable toner.

As stated above, if the part decoloring toner mode is selected, it is possible to automatically print locations where the bold characters or underlines, the red characters and the like are recorded with the use of the decolorable toner.

Subsequently, the erasing job shown in FIG. 12 is recorded. As a condition, the sheet P to be erased is set in the paper feed tray 222 of the paper feed section 220. Then, the sheet P is printed in the above-mentioned part decoloring toner mode of the MFP 100. The print content of the sheet P set in the paper feed tray 222 of the paper feed section 220 is identical to that shown in FIG. 10, and the characters "B" and the characters "C" recorded on the sheet P are printed with the decolorable toner. In the following processing, after the sheet P is read and stored, a processing of erasing the image on the sheet P is described as an example. The first route change section 210 is connected with the first conveyance path 290 and the paper discharge section 280 by default.

Firstly, in ACT S201, the control section 250 controls the paper feed section 220 to feed the sheet P set in the paper feed tray 222 to convey the sheet P to the first conveyance path 290. Specifically, the control section 250 picks up the sheets P set in the paper feed tray 222 one by one with the use of the paper feed tray pickup roller 221. Then, the control section 250 controls the sheet conveyance motor control driving section 209 to activate the sheet conveyance motor 213 to drive the conveyance roller 286 to convey the sheet P in the first conveyance path 290.

After that, both sides of the sheet P are read by the first reading section 232*a* and the second reading section 232*b* arranged across the first conveyance path 290, and the read images are stored in the read image storage area of the HDD 212 (ACT S202).

The first route change section 210 allows the default position of the route for conveying the sheet P from the paper feed section 220 to the paper discharge section 280. Thus, before the reading processing, the control section 250 controls the first route change driving section 207 to drive the first route change section 210 to change the route to be capable of conveying the sheet P to the second conveyance path 295 via the branch point B1. In this way, the conveyance path from the second reading section 232*b* to the erasing section 250 is connected.

The erasing section 250 is arranged in the second conveyance path 295. The control section 250 conveys the sheet P to the erasing section 250 via the branch point B1 of the first conveyance path 290 and the second conveyance path 295 (ACT S203). The sheet P conveyed to the erasing section 250 is sandwiched by the roller pair 251 heated by the heater 205 to be conveyed. The image (toner) formed on the conveyed sheet P is heated by the erasing section 250. Then, the temperature of the toner formed on the sheet P rises to the temperature set in ACT S2 to be decolored. As stated above, in the present embodiment, the characters "B" and the characters "C" on the sheet P are formed with the decoloring toner. Thus, in the erasing section 250, if the sheet P is heated by the heater 205, the characters "B" and the characters "C" are erased (ACT S204).

The control section 250 conveys the sheet P to the first conveyance path 290 again via the merging point G of the first conveyance path 290 and the second conveyance path 295 at the upstream side of the first reading section 232*a* and the second reading section 232*b* (ACT S205).

The control section 250 controls the first reading section 232*a* and the second reading section 232*b* arranged in the first conveyance path 290 to read the surfaces of the sheet P of which the images are erased. The read images are stored in the redetermination storage area of the HDD 212 (ACT S206).

The control section 250, with respect to the images stored in the redetermination storage area of the HDD 212, refers to the threshold value of the printing rate of the sheet and the threshold value of the density stored in the ROM 202 to determine whether or not the sheet can be reused (ACT S207).

In a case in which the sheet P as shown in FIG. 10 is erased, as there are many areas printed with the toner that cannot be erased, the control section 250 determines that the sheet P cannot be reused (No in ACT S207).

If the control section 250 determines that the sheet P cannot be reused (No in ACT S207), the control section 250 controls the first route change driving section 207 and the second route change driving section 208 to drive the first route change section 210 and the second route change section 215 to switch the routes. Through the control, the sheet P can be conveyed to the second paper discharge section 270 via the branch points B1 and B2. In this way, the conveyance path from the second reading section 232*b* to the second paper discharge section 270 is connected. If the conveyance path from the second reading section 232*b* to the second paper discharge section 270 is connected, the sheet P is conveyed to the second paper discharge section 270. In this way, the sheet P that cannot be reused is housed in the second paper discharge section 270 (ACT S209).

On the other hand, a case in which all parts of the sheet are printed with the decolorable toner and the decolored sheet is in a good state is described. In this case, the control section 250 determines that the sheet can be reused (Yes in ACT S207). If the control section 250 determines that the sheet can be reused, the control section 250 drives the first route change driving section 207 to switch the route. Through the control, the sheet can be conveyed to the first paper discharge section 260 via the branch point B1. In this way, the conveyance path from the second reading section 232*b* to the first paper discharge section 260 is connected. If the conveyance path from the second reading section 232*b* to the first paper discharge section 260 is connected, the sheet is conveyed to the first paper discharge section 260. In this way, the reusable sheet is housed in the first paper discharge section 260 (ACT S208).

Figure 13:
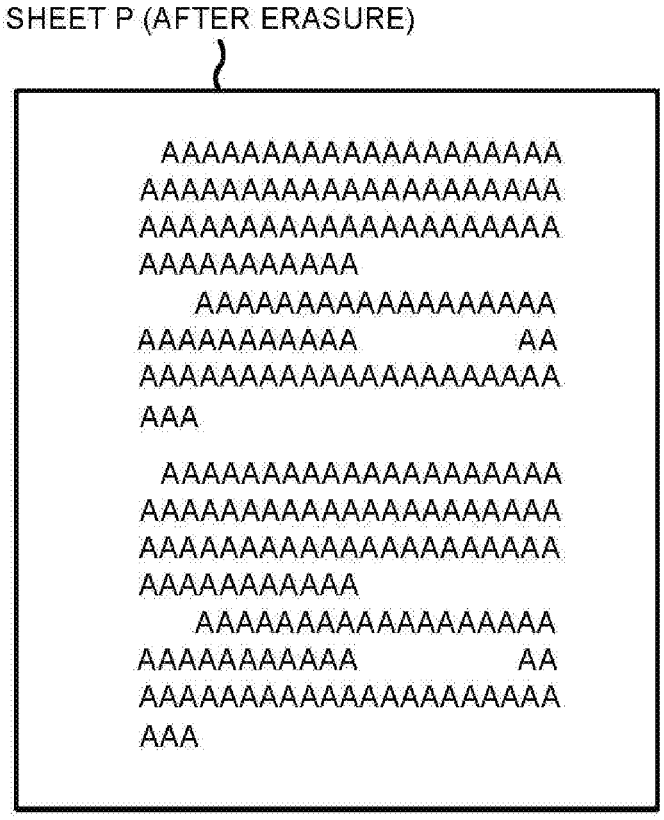
FIG. 13 is a diagram illustrating a sheet after erasing according to the first embodiment and the second embodiment.

Through the foregoing configuration, as to document files created in various forms, it is possible to automatically print the emphasis information recorded on the sheet copied with the decolorable toner. For example, in order that document used in a conference can attract attention of a customer or a boss to achievement or selling points, there is a trend that important points of the document are added with underline or become bold type and are highlighted. The highlighted information is often important information. Therefore, the operator is possible to erase the important information (in other words, the emphasized information) in the document with an easy operation. In addition, in a case in which the sheet is erased by the image erasing apparatus, emphasized locations printed with the decolorable toner are erased and the image printed with the non-decolorable toner remains on the sheet without being erased as shown in FIG. 13. Then, the sheet after erased is read by the first reading section 232*a* and the second reading section 232*b* again. At this time, as the printing with the non-decolorable toner remains on the sheet, the sheet is automatically conveyed to the second paper discharge section 270 for disposal. In this way, the document of which the important information (in other words, the emphasized information) is erased is seldom recycled.

Further, the emphasis information is exemplified as a location where the image is formed with the decoloring toner in each embodiment described above; however, the present invention is not limited to this. For example, it is also possible to register blue serving as the color of the decoloring toner in a file equivalent to the emphasis information candidate file 55*a*. Then, in the part decoloring toner mode, if the color of the decoloring toner is selected and the copying is carried out on the screen shown in FIG. 11, in a case of the document on which the images formed with the decoloring toner and the non-decoloring toner are mixed is printed, the operator can acquire the sheet having the same configuration as the document serving as copy source. In other words, the operator can acquire the sheet identical to the copied document by forming the image formed with the use of the decoloring toner with the decoloring toner and forming the image formed with the use of the non-decoloring toner with the non-decoloring toner.

For example, it is also possible to register ruled lines as a template in the file equivalent to the emphasis information candidate file 55*a*. In this case, at the time the document is copied, at the registered ruled line part, the image is formed with the non-decoloring toner and the image other than that image formed with the non-decoloring toner is formed with the decoloring toner. In this way, the operator can repeatedly use only a predetermined template part by carrying out the decoloring processing. Further, in the foregoing embodiment, by changing the setting, for example, only the predetermined template part may be formed with the decoloring toner.

Second Embodiment

Figure 14:
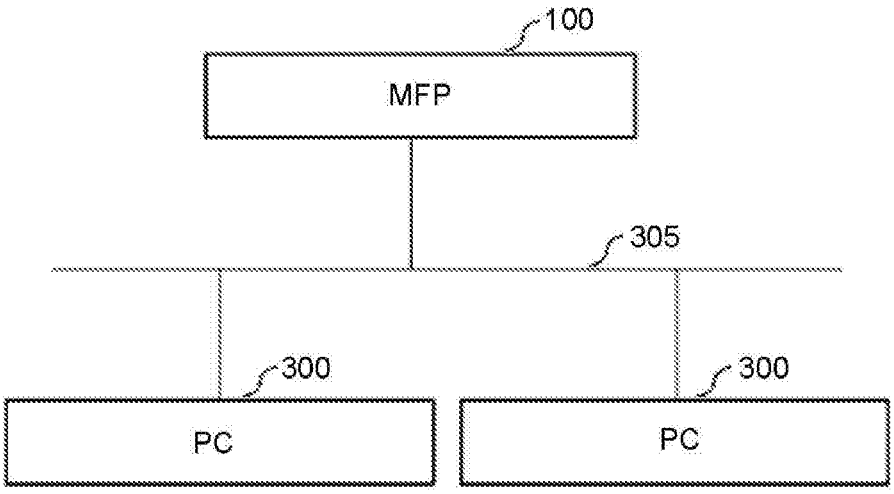
FIG. 14 is a diagram schematically illustrating connection of the MFP and a PC according to the second embodiment.

Next, the second embodiment is described. The description of the same reference numerals of the MFP 100 and the image erasing apparatus 200 as those in the first embodiment is omitted. The external I/F 56 of the MFP 100 is the network interface for communication via the network. In the second embodiment, as shown in FIG. 14, a PC (Personal Computer) 300 and the MFP 100 are connected with the network via an LAN (Local Area Network) 305.

Further, in the second embodiment, an emphasis information candidate file 353*a* as shown in FIG. 16 and an emphasis information candidate area 353*b* (a storage area of the emphasis information candidate area 353*b* is equivalent to a second storage section) as shown in FIG. 17 are held in an HDD 358 of the PC 300. The emphasis information candidate file 353*a* and the emphasis information candidate area 353*b* are equivalent to the emphasis information candidate file 55*a* and the emphasis information storage file 55*b* stored in the HDD 55 of the MFP 100. The emphasis information candidate file 353*a* and the emphasis information candidate file 55*a* have a correspondence relationship, and the emphasis information candidate area 353*b* and the emphasis information storage file 55*b* also have a correspondence relationship.

Figure 15:
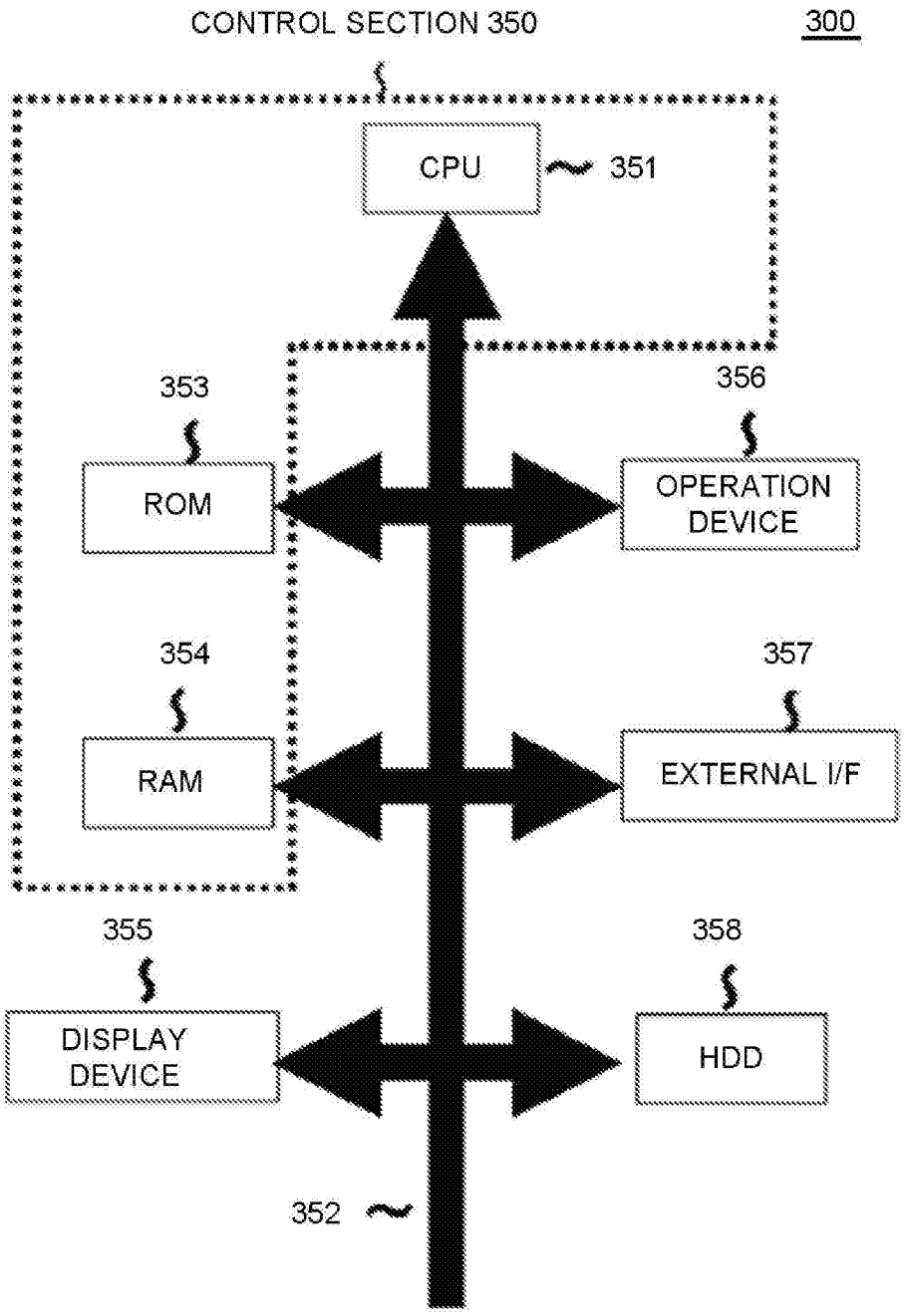
FIG. 15 is a block diagram of the PC according to the second embodiment.

A block diagram of the PC 300 is shown in FIG. 15. A CPU 351, a ROM 353, a RAM 354, a display section 355, an operation device 356, an external I/F 357 (equivalent to a communication section) and the HDD 358 are connected with one another via the system bus line 352. Further, the CPU 351 the ROM 353 and the RAM 354 constitute a control section 350.

A program for enabling the control section 350 to operate and a threshold value are stored in the ROM 353 in advance.

In the RAM 354, a memory area serving as a working area of a data processing according to the program is dynamically formed. Further, a mode management flag is stored in the RAM 354. In a case in which the part decoloring toner mode is selected, "1" is set in the mode management flag, and in a case in which the part decoloring toner mode is not selected, "0" is set in the mode management flag.

The display section 355 is a device for displaying information to the operator.

The operation device 356 is a device such as a key board, a mouse and the like for inputting necessary information to the PC 300.

The external I/F 357 is an interface for communicating with the external device. For example, the external I/F 357 is the network interface for communication via the network. The external I/F 357 receives or sends data from or to the MFP 100.

The HDD 358 is a high capacity storage device. An OS (Operating System) for enabling the PC 300 to operate is installed in the HDD 358. Further, a printer driver serving as software for printing a document file by the MFP 100 is also installed in the HDD 358. The emphasis information candidate file 353*a* and the emphasis information candidate area 353*b* described above are stored in the HDD 358 as a part of the printer driver. Further, the HDD 358 also stores the document file the operator wants to print (an area for storing the document file to be printed is equivalent to a first storage section).

In a case in which the document file stored in the HDD 358 is printed, a print command described in a page description language such as postscript data is used. The printer driver creates the print command described in the page description language on the basis of the content of the document file. The page description language refers to a program language for instructing the MFP 100 at the time a document or an image created on a computer is printed with the MFP 100. In the page description language, position information and blank form information (font color, underline, bold type) of characters or figures are recorded. When the document file is printed with the MFP 100, a bitmap image is created on the basis of the description of the page description language of the received print command. Then, in the second embodiment, the control section 350 determines the emphasis information to print with the decolorable toner on the basis of the content described in the page description language.

In a case in which the printing is carried out with the printer driver, a part printing mode can be selected. In a case in which the part printing mode is selected, it is possible to select the part printing mode by checking a radio button from a GUI (Graphical User Interface) screen (not shown), displayed on a display device 355, which is generated by the printer driver as an example. If the part printing mode is selected, a processing is carried out in such a manner that the object indicated by the emphasis information is printed with the decolorable toner. A printing key is displayed on the GUI of the printer driver. In a case in which the part printing mode is selected, the GUI screen is switched to a screen for selecting the emphasis information by pressing the displayed printing key. On the other hand, in a case in which the part printing mode is not selected, if the printing key is pressed, a processing in which the print command is not rewritten is carried out.

Figure 18:
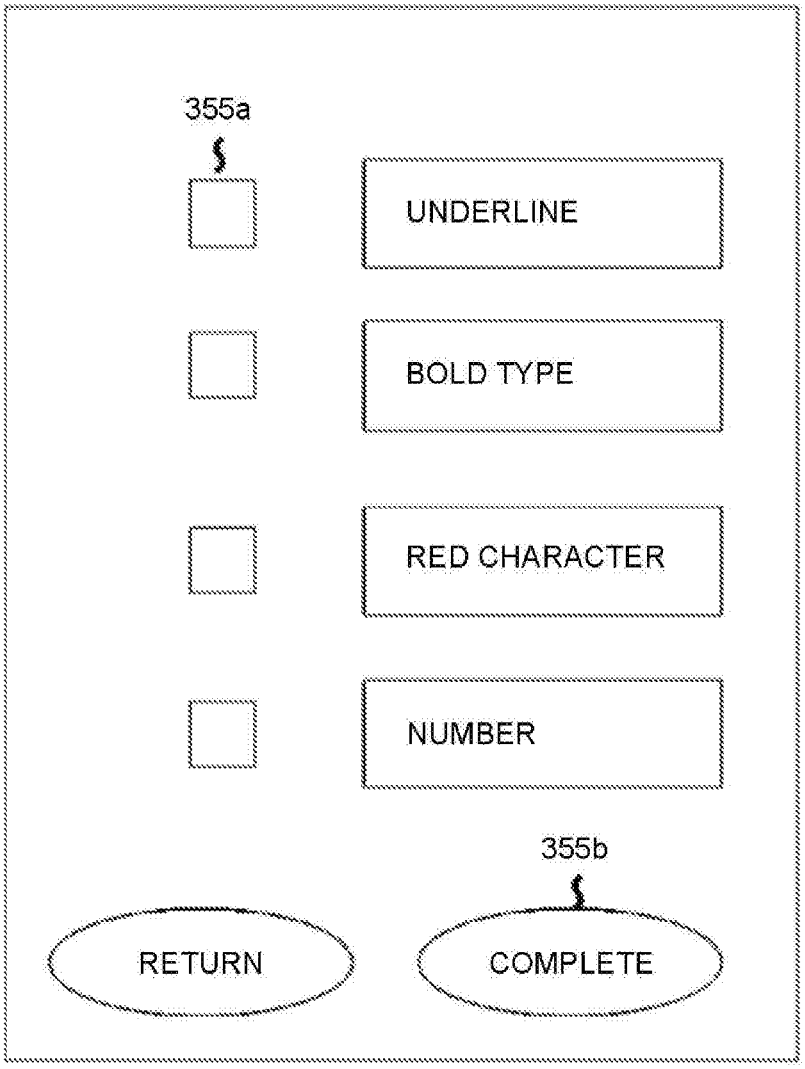
FIG. 18 is a diagram illustrating a display example of a screen displayed on a display section according to the second embodiment.

With a key signal of the printing key input, a screen as shown in FIG. 18 separately from the GUI screen is opened. As shown in FIG. 18, the emphasis information stored in the emphasis information column of the emphasis information candidate file 353*a* and the corresponding check box 355*a* are displayed on the display section 355. Further, a completion key 355*b* is displayed at the lower side of the display section 355. If a check box 355*a* is checked by the operator and the completion key 355*b* is pressed, the control section 350 reads out the emphasis information and the identifier corresponding to the checked check box 355*a* from the emphasis information candidate file 353*a* to store the emphasis information and the identifier in the emphasis information candidate area 353*b*.

Figure 19:
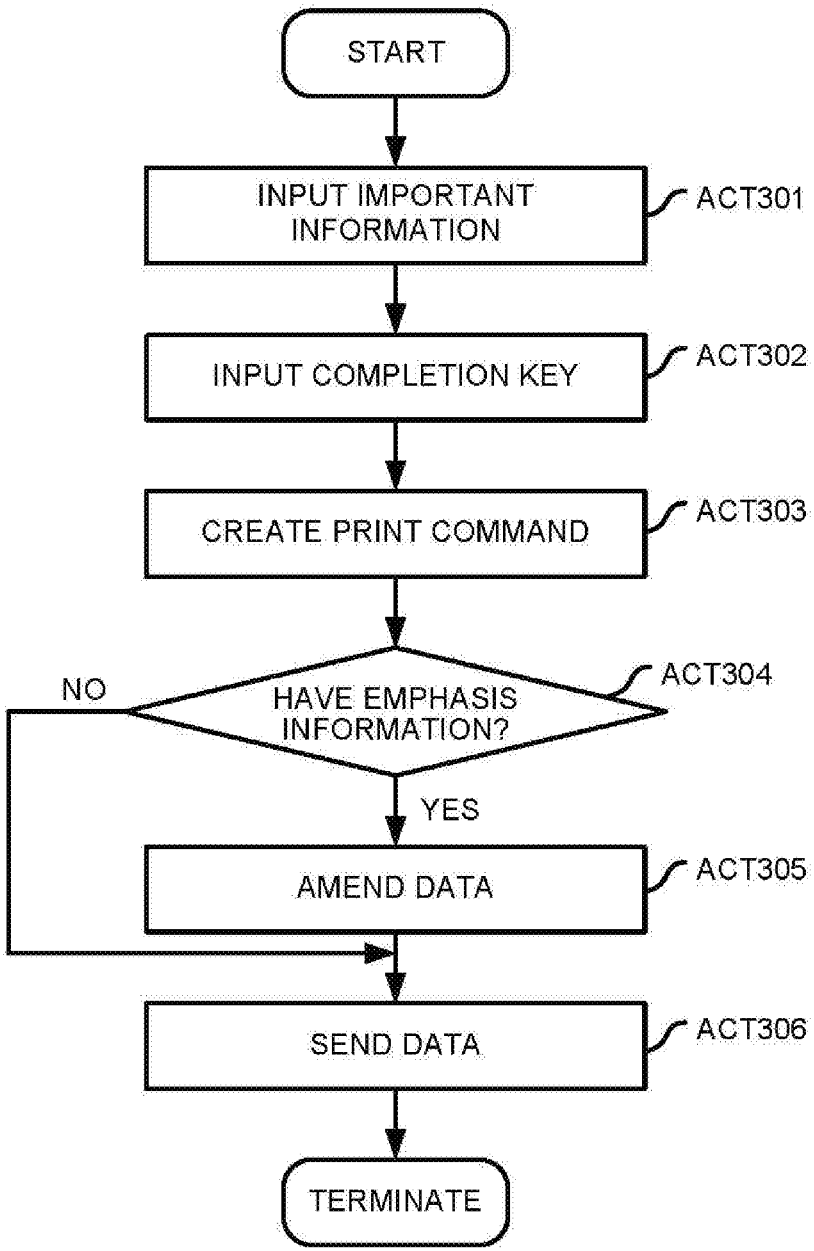
FIG. 19 is a flowchart illustrating a process of a print request job according to the second embodiment.

In the PC 300 with the foregoing configuration, the control section 350 executes a print request job shown in FIG. 19 according to a preset program. At this time, the MFP 100 and the PCs 300 are connected with each other as shown in FIG. 14. The document file as shown in FIG. 10 is created with the document software and the printing is carried out. Further, in the default setting already, "1" is stored in the mode management flag of the RAM 354, and the part printing mode is selected. Further, it is set that the printer driver uses the black toner in the default setting. In the print request job, the document file as shown in FIG. 10 is printed. In other words, the characters of "B" in bold type and the characters of "C" with underline are recorded in the document file. The operator operates the operation panel 4 to press the part erasing key to carry out the copying in the part decoloring toner mode. Further, the operator selects the characters marked by the bold type and the underline to print them with the decolorable toner.

The GUI screen for printing generated by the printer driver is displayed on the display device 355. The printing key is displayed on the GUI screen. Further, on the GUI screen, a check is already input to the part printing mode. The control section 350 receives the input of the key signal of the printing key. The control section 350 refers to the mode management flag to confirm that "1" is stored in the RAM 354. If the control section 350 confirms that the part printing mode is selected, the emphasis information in the emphasis information candidate file 353*a* is displayed on the display section 355 as shown in FIG. 18. Then, a random check is input to the check box 355*a* at the left side of the displayed emphasis information via the display section 355. In the present embodiment, checks are input to the check boxes of the underline and the bold type (ACT S301).

Then, if the completion key 355*b* is pressed, the control section 350 reads out the selected emphasis information from the emphasis information candidate file 353*a* to store the emphasis information in the emphasis information candidate area 353*b*. In the present embodiment, the underline and the bold type are stored in the emphasis information column, and 0001 and 0002 serving as the identifiers of the underline and the bold type are stored in the corresponding identifier columns (ACT S302).

After that, the control section 350 creates the print command according to the page description language on the basis of the document file serving as the object (ACT S303).

After the print command is created, the control section 350 determines whether or not the emphasis information stored in the emphasis information candidate area 353*b* of the HDD 358 exists in the created print command (ACT S304).

If it is determined that the emphasis information does not exist in the print command (No in ACT S304), the control section 350 sends the print command created in ACT S303 to the MFP 100 via the external I/F 357 (ACT S306).

On the other hand, if it is determined that the emphasis information exists in the print command (Yes in ACT S304), the control section 350 rewrites the print command created in ACT S303 to carry out a processing of creating a print command again. As stated above, the print command is recorded in the page description language, and the position information and the blank form information (font size, presence or absence of the bold type and the underline) of the characters or the figures of the document file to be printed are recorded in the page description language. The control section 350 retrieves the emphasis information stored in the emphasis information candidate area 353*b* of the HDD 358 from the print command and rewrites the color of the character of the blank form information at a corresponding location to print the location with the decolorable toner to create a print command (ACT S305). The creation of the print command in ACT S305 also contains amendment or rewriting of the foregoing print command created in ACT S303. In the present embodiment, the control section 350 retrieves the presence or absence of the bold type and the underline from the print command and rewrites the print command to print the corresponding location with the decolorable toner.

Then, the control section 350 sends the print command to the MFP 100 via the external I/F 357 (ACT S306) and then terminates the processing. Further, if the MFP 100 receives the print command, the control section 350 creates image data according to the print command to carry out the printing processing.

The sheet printed by the MFP 100 is erased by the image erasing apparatus 200 as stated in the first embodiment. Further, the erasure of the image in the second embodiment is identical to that in the first embodiment, and thus the description thereof is omitted.

Through the above, as to the document files created in various forms, it is possible for the operator to automatically print the important information (emphasized information) recorded on the sheet to be copied with the decolorable toner without carrying out a complicated setting process. When the document file is created, if the locations the operator wants to erase are created with the underline and the bold type, it is possible for the operator to cancel any location with the easy operation. In other words, in a process of creating a document for conference or a document for presentation, it is possibly set for the MFP 100 to automatically print the location (in other words, the important information) emphasized spontaneously with the decolorable toner, and the burden of the operator, in other words, the operator is aware of locations he/she wants to erase to create a document, is reduced.

In the first embodiment, the image information is acquired from the scanner section 1; however, for example, the image information may be received through the communication from the external I/F.

In the second embodiment, after the print command created in the page description language is created, the rewriting is carried out; however, for example, at the stage of creating the print command in the page description language, after the character information of the document file is analyzed to determine whether or not the emphasis information is stored in the document file, the print command may be created in the page description language to print the document file with the decolorable toner initially.

In the second embodiment, in the part decoloring toner mode, after converting the print command created in the page description language, the PC 300 sends the converted print command to the MFP 100. However, it is certainly considered to rewrite the print command with the MFP 100 without rewriting the print command with the PC 300. In this case, for example, a flag indicating the printing is in the part decoloring toner mode is recorded in the print command in advance. Then, after the MFP that receives the print command confirms the flag, a rewriting processing to print the emphasis information stored by the print command from the emphasis information candidate area 353*b* stored in the HDD with the decolorable toner may be carried out.

The first storage section and the second storage section may be formed integrally or separately.

Further, in the present embodiment, it is described that the color of the image is erased as an example of the erasing processing; however, the method of erasing the image is not limited to this. In other words, the image erasing apparatus recorded in the present embodiment is not limited to an apparatus for erasing the color of the image through the heating. For example, the image erasing apparatus may be an apparatus for decoloring the color of the image on the sheet through irradiation of light or an apparatus for erasing the image formed on the sheet by using chemicals and the like. The image erasing apparatus may be optional apparatus as long as it enables the image on the sheet to be invisible in order to be capable of reusing the sheet.

While certain embodiments are described, these embodiments are presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a touch panel comprising input buttons and a display and configured to input a normal printing mode in which printing is carried out with a non-decolorable recording material or a partial decoloring recording material mode in which printing is carried out with a decolorable toner and the non-decolorable recording material;

a storage section configured to store an image information and an emphasis information for emphasizing a specific image;

a printing section comprising a decolorable recording material and a non-decolorable recording material and configured to print an image based on the image information stored in the storage section; and a control section configured to control the printing section to print the image indicated by the emphasis information stored in the storage section with the decolorable recording material based on the input information by the touch panel in a case in which the image based on the image information stored in the storage section includes the emphasis information.

2. The image forming apparatus according to claim 1, wherein the control section controls the printing section to print the image based on the image information stored in the storage section with the non-decolorable recording material in a case in which the image does not record the emphasis information.

3. The image forming apparatus according to claim 1, wherein the touch panel is further configured to input the emphasis information, and the storage section stores the emphasis information selected and input by the touch panel.

4. The image forming apparatus according to claim 1, further comprising a reading section configured to read an image of a sheet, wherein the storage section stores the image read by the reading section as the image information.

5. The image forming apparatus according to claim 1, further comprising a communication section configured to receive information relating to printing from an external terminal, wherein the storage section stores the image information relating to the printing received by the communication section.

6. The image forming apparatus according to claim 1, wherein the predetermined condition is a fixing temperature.

7. The image forming apparatus according to claim 1, wherein the emphasis information comprises at least one of bold type, underline, red characters, numbers, italics, color painting, and hatching.

8. The image forming apparatus according to claim 1, further comprising a temperature sensor.

9. An image forming apparatus, comprising:

a touch panel comprising input buttons and a display and configured to input a normal printing mode in which printing is carried out with a non-decolorable recording material or a partial decoloring recording material mode in which printing is carried out with a decolorable recording material and the non-decolorable recording material;

a storage section configured to store image information and emphasis information for emphasizing a specific image;

a printing section comprising a decolorable recording material and a non-decolorable recording material and configured to print an image based on the image information stored in the storage section with the decolorable recording material in a case in which the first image meets a predetermined fixing temperature; and a control section configured to control the printing section to print the image indicated by the emphasis information stored in the storage section with the decolorable recording material based on the input information by the touch panel in a case in which the first image meets the predetermined fixing temperature existing in the image information stored in the storage section.

10. The image forming apparatus according to claim 9, wherein the control section controls the printing section to print the image based on the image information stored in the storage section with the non-decolorable recording material in a case in which the image does not meet the predetermined fixing temperature.

11. The image forming apparatus according to claim 9, wherein the touch panel is further configured to input the emphasis information, and the storage section stores the emphasis information selected and input by the touch panel.

12. The image forming apparatus according to claim 9, further comprising a reading section configured to read an image of a sheet, wherein the storage section stores the image read by the reading section as the image information.

13. The image forming apparatus according to claim 9, further comprising a communication section configured to receive information relating to printing from an external terminal, wherein the storage section stores the image information relating to the printing received by the communication section.

14. The image forming apparatus according to claim 9, wherein the emphasis information comprises at least one of bold type, underline, red characters, numbers, italics, color painting, and hatching.

15. The image forming apparatus according to claim 9, further comprising a temperature sensor.

* * * * *